US010677113B2

(12) United States Patent
Altherr et al.

(10) Patent No.: US 10,677,113 B2
(45) Date of Patent: Jun. 9, 2020

(54) ROCKER ARM ARRANGEMENT

(71) Applicant: Mahle International GmbH, Stuttgart (DE)

(72) Inventors: Patrick Altherr, Stuttgart (DE); Herrn R. Kirschner, Esslingen (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 16/048,201

(22) Filed: Jul. 27, 2018

(65) Prior Publication Data

US 2019/0032525 A1 Jan. 31, 2019

(30) Foreign Application Priority Data

Jul. 28, 2017 (DE) ..... 10 2017 213 085

(51) Int. Cl.

| | |
|---|---|
| ***F01L 1/34*** | (2006.01) |
| ***F01L 13/00*** | (2006.01) |
| ***F01L 1/18*** | (2006.01) |
| ***F01L 1/047*** | (2006.01) |
| ***F01L 1/053*** | (2006.01) |

(52) U.S. Cl.

CPC ..... *F01L 13/0036* (2013.01); *F01L 1/047* (2013.01); *F01L 1/053* (2013.01); *F01L 1/18* (2013.01); *F01L 1/181* (2013.01); *F01L 2105/00* (2013.01); *F01L 2105/02* (2013.01)

(58) Field of Classification Search

CPC ..... F01L 1/18; F01L 1/181; F01L 13/0036; F01L 2105/00

USPC ..... 123/90.16, 90.18

See application file for complete search history.

(56) References Cited

U.S. PATENT DOCUMENTS 10,371,020 B2 * 8/2019 Altherr ..... 123/90.18

FOREIGN PATENT DOCUMENTS

| | | | |
|---|---|---|---|
| DE | 10 2007 048 915 | A1 | 4/2009 |
| DE | 10 2009 006 632 | A1 | 8/2010 |
| DE | 202015009047 | U1 | 8/2016 |
| DE | 10 2015 215 123 | A1 | 2/2017 |
| JP | H06212924 | A | 8/1994 |

OTHER PUBLICATIONS

English abstract for DE-20 2015 009 047.

(Continued)

*Primary Examiner* — Ching Chang

(74) *Attorney, Agent, or Firm* — Fishman Stewart PLLC

(57) ABSTRACT

A rocker arm arrangement for a valve drive of an internal combustion engine may include a roller shaft including at least one roll and an adjusting arrangement configured to adjust the roller shaft between a first position and a second position. The rocker arm arrangement may also include a first cam and a second cam respectively having a cam stroke region and an idle speed region and secured to a cam shaft. The adjusting arrangement may include a first engagement pin and a second engagement pin arranged on the roller shaft and adjustable into a switching position and into a home position. The first guide track and the second guide track may be respectively arranged on the cam shaft in a circumferential direction of the cam shaft at least partially overlapping one of the cam stroke region of the first cam and the cam stroke region of the second cam.

20 Claims, 3 Drawing Sheets

(56) References Cited

OTHER PUBLICATIONS

English abstract for DE-10 2015 215 123.
English abstract for DE-10 2007 048 915.
English abstract for DE-10 2009 006 632.
English abstract for JP-H01212924.

* cited by examiner

ROCKER ARM ARRANGEMENT

CROSS-REFERENCE TO RELATED APPLICATIONS

This application claims priority to German Patent Application No. DE 10 2017 213 085.7, filed on Jul. 28, 2017, the contents of which are hereby incorporated by reference in its entirety.

TECHNICAL FIELD

The invention relates to a rocker arm arrangement for a valve drive of an internal combustion engine.

BACKGROUND

A rocker arm arrangement is used in a valve drive of an internal combustion engine in order to control valves. A rocker arm, which is connected to a valve, is rotatably mounted on a rocker arm axis for this purpose. A roller shaft comprising a rotatable roll is further secured to the rocker arm, which can be adjusted back and forth into a first position and into a second position. The roll is thus alternately connected to a first cam or to a second cam in a driving manner. The two cams are secured to a rotatable cam shaft and have profiles, which differ from one another in the circumferential direction, each comprising a cam stroke. If the roll is drivingly connected to the first cam, the roll follows the profile of the first cam, and the roller shaft as well as the rocker arm perform a stroke movement, which corresponds to the profile of the first cam. The roll, which is drivingly connected to the second cam, thus follows the profile of the second cam, and the roller shaft as well as the rocker arm perform a different stroke movement. The stroke motion sequence of the cylinder valve, which is secured to the rocker arm, can be changed in this way.

To connect the roll alternately to the first cam or to the second cam, two engagement pins are typically adjustably arranged in the roller shaft. In a switching position, the engagement pins can each interact with a guide track, by means of which the engagement pin and the roller shaft are shifted parallel to the rocker arm axis. The shifting of the roller shaft into the first and into the second position can thereby only take place when the two cams do not pass through a cam stroke on the roll. In addition, the respective engagement pin also has to be pushed out of the guide track into a home position after the adjustment of the roller shaft. As a result of the very short available time interval, the respective engagement pin is subjected to high acceleration and adjusting forces. The slide guides comprising the respective guide tracks are further also mechanically stressed to a high degree.

SUMMARY

It is thus the object of the invention to specify an improved or at least an alternative embodiment for a rocker arm arrangement of the generic type, in the case of which the described disadvantages are overcome.

According to the invention, this object is solved by the subject matter of the independent claim(s). Advantageous embodiments are the subject matter of the dependent claim(s).

The present invention is based on the general idea of increasing an available time for adjusting a roller shaft in a rocker arm arrangement. The roller shaft of the rocker arm arrangement according to the invention for a valve drive of an internal combustion engine has a roll, which is rotatably mounted and axially secured to the roller shaft. The roller shaft can be adjusted back and forth in the adjusting direction into a first position and into a second position by means of an adjusting arrangement, wherein, in the first position, the roll of the roller shaft is operatively connected to a first cam, and, in the second position, to a second cam. The respective cam thereby has a cam stroke region and an idle speed region and is secured in a rotationally fixed manner to a cam shaft, which can be rotated about an axis of rotation. The adjusting arrangement has a first engagement pin and a second engagement pin, which can be adjusted into a switching position and into a home position in the roller shaft perpendicular to the adjusting direction. In the switching position, the first engagement pin thereby interacts with a first guide track or the second engagement pin interacts with a second guide track, and there is no contact with the respective guide track in the home position. According to the invention, the first guide track is arranged on the cam shaft in the circumferential direction of the cam shaft so as to overlap at least partially with the cam stroke region of the first cam or with the cam stroke region of the second cam, and the second guide track so as to overlap at least partially with the cam stroke region of the second cam or with the cam stroke region of the first cam. In the switching position, the respective engagement pin interacts with the respective guide track and, according to the invention, is also guided further from the idle speed region in the cam stroke region of the respective cam. In the idle speed region (base circle) of the cam, a radius of the cam thereby remains equal to a minimal value, and in the cam stroke region (cam peak), the radius of the cam changes steadily from the minimal value to a maximal value and back from the maximal value to the minimal value again. The cam stroke region and the guide track are arranged so as to overlap in the circumferential direction of the cam shaft, so that the respective engagement pin is also located in the guide track when the cam stroke region abuts on the roll. The radius of the cam increases steadily in the cam stroke region, so that the respective engagement pin is also steadily removed from the guide track by means of the stroke movement of the roller shaft. When the cam stroke region and the guide track overlap, the respective engagement pin can thus be guided further until the complete removal, whereby the time for adjusting the roller shaft is increased in an advantageous manner.

The first guide track and the second guide track can thereby be formed by a radial recess each in an outer surface of a first slide guide and a second slide guide. The respective radial recess thereby revolves at least partially around the axis of rotation of the cam shaft. The slide guides can then be secured to the cams on both sides and on the cam shaft in a rotationally fixed manner. The respective guide tracks are thus also arranged securely in the circumferential direction relative to the respective cam stroke regions and the respective idle speed regions. In this embodiment, the engagement pins are advantageously also arranged on both sides of the roll. In the alternative, the two guide tracks can be arranged on a shared slide guide and the shared slide guide can be secured laterally to the cams. The two engagement pins are advantageously also arranged on one side of the roll.

It is advantageously provided in a further development of the rocker arm arrangement according to the invention that the respective guide track has at least one idle speed track and at least one axial guide track. The respective engagement pin can thereby be adjusted axially to the axis of rotation by means of the axial guide track and is held axially to the axis of rotation by means of the idle speed track. The axial guide track thereby has an angle to the circumferential direction of the cam shaft, so that the respective engagement pin is shifted perpendicular/obliquely to the circumferential direction and accordingly axially to the axis of rotation in response to the rotation of the slide guide. The respective engagement pin is thereby secured axially to the axis of rotation in the roller shaft and entrains the roller shaft in response to the axial shifting to the axis of rotation. The roller shaft can be adjusted into the first position or into the second position in the adjusting direction in this way. The idle speed track runs in the circumferential direction and the respective engagement pin is not axially shifted by means of the idle speed track. The axial guide track can advantageously merge into the idle speed track and the idle speed track can merge into the axial guide track, so that the respective engagement pin can be guided without interruption in the guide track.

It is also provided that at least one of the respective engagement pins is adjusted axially to the axis of rotation downstream from the respective axial guide track and is in the switching position in the respective cam stroke region of the respective cam.

It is advantageously provided that the respective idle speed track is arranged so as to overlap at least partially with the cam stroke region of the respective cam in the circumferential direction of the cam shaft. In the alternative, the respective idle speed track can also be arranged so as to overlap completely with the cam stroke region of the respective cam in the circumferential direction of the cam shaft. The respective engagement pin is thus already adjusted before the cam stroke of the respective cam overlaps with the idle speed region and is only guided along the circumferential direction in the idle speed track. The respective axial guide track can advantageously be arranged so as to overlap at least partially or, in the alternative, so as to overlap completely, with the idle speed region of the respective cam in the circumferential direction of the cam shaft.

When the guide track overlaps with the idle speed region of the respective cam, the respective engagement pin is thus shifted axially to the axis of rotation in the axial guide track, and the roller shaft is adjusted accordingly from one position into the other position. When the respective guide track overlaps with the cam stroke region of the respective cam, the respective engagement pin is guided in the circumferential direction in the idle speed track. The adjusting of the respective engagement pin axially to the axis of rotation can thus take place until the guide track overlaps with the cam stroke region, and the time for adjusting the engagement pin is thus increased.

It is advantageously provided that the respective axial guide track and a total idle speed region of the two cams are arranged so as to overlap completely in the circumferential direction of the cam shaft. In the total idle speed region, the idle speed region of the first cam and the idle speed region of the second cam are thereby arranged so as to overlap in the circumferential direction of the cam shaft. In the total idle speed region, the roll of the roller shaft can be adjusted from the first cam to the second cam and back, without one of the cam stroke regions of the two cams preventing an adjusting of the roll.

To adjust the respective engagement pin from the switching position into the home position, it is advantageously provided that, on the outer surface, the respective slide guide has a resetting surface, which is arranged so as to overlap at least partially with the idle speed region or with the cam stroke region of the respective cam in the circumferential direction of the cam shaft. When the idle speed track overlaps with the cam stroke region, the radius of the cam and thus the distance of the engagement pin to the cam shaft increase steadily. The respective engagement pin is removed from the idle speed track by means of the stroke movement of the roller shaft. To adjust the respective engagement pin from the switching position into the home position, the respective engagement pin can be removed completely from the idle speed track when the idle speed track overlaps with the cam stroke region, and can be adjusted into the home position by means of striking against the resetting surface of the respective slide guide only in response to a reverse stroke movement of the roller shaft. When the idle speed track overlaps with the cam stroke region of the respective cam, the roller shaft is already adjusted into the first position or into the second position, and the respective engagement pin is only guided in the circumferential direction on the cam shaft. The adjusting of the engagement pin into the home position thus takes place at a later point in time, without the motion sequence of the roller shaft being disturbed thereby. The resetting surface is thereby located on the outer surface of the respective slide guide, so that the respective slide guide can be produced with reduced effort and in a technically simple manner.

In an alternative embodiment of the rocker arm arrangement, it is provided that the respective idle speed track has a ramp region. The respective engagement pin can be adjusted perpendicular to the adjusting direction and to the axis of rotation of the cam shaft in the roller shaft by means of the ramp region. The ramp region of the respective idle speed track can thereby increase from the recess in the respective slide guide to the outer surface of the respective slide guide, so that the engagement pin can be carefully adjusted from the switching position into the home position.

The ramp region of the respective idle speed track can thereby be arranged so as to overlap at least partially with the cam stroke region of the respective cam in the circumferential direction of the cam shaft. When the idle speed track overlaps with the cam stroke region, the radius of the cam increases steadily and the engagement pin is removed from the idle speed track by means of the stroke movement of the roller shaft. The engagement pin can be supported in its stroke movement by means of the ramp region in the idle speed track, in that the radius of the respective slide guide in the ramp region increases more than the radius of the cam in the cam stroke region.

In the alternative, it can be provided that the ramp region of the respective idle speed track is arranged so as to overlap at least partially with the idle speed region of the respective cam in the circumferential direction of the cam shaft. The respective idle speed track is thereby arranged so as to overlap with the cam stroke region of the respective cam and extends across the complete cam stroke region into the idle speed region of the respective cam. In response to the stroke movement of the roller shaft, the engagement pin is removed from the idle speed track and dips into the idle speed track again in response to the reverse stroke movement of the roller shaft. In the idle speed track, the respective engagement pin is guided through the ramp region in the circumferential direction and is thus adjusted into the home position.

In addition, it can be provided that the respective idle speed track is interrupted by an interruption region, wherein the interruption region is arranged so as to overlap with the cam stroke region of the respective cam in the circumferential direction of the cam shaft. The interruption region thereby interrupts the idle speed track at that location, where the respective engagement pin is removed from the idle speed track by means of the stroke movement of the roller shaft. In the case of this embodiment, the production effort can be reduced. The idle speed track comprising the ramp region, which overlaps with the idle speed region, can thereby be embodied in the form of a flattened recess in the slide guide, in order to reduce the production effort.

As a whole, the time for adjusting the respective engagement pins axially to the axis of rotation can be extended by means of the rocker arm arrangement according to the invention, so that the mechanical stress on the respective engagement pins can be reduced advantageously.

Further important features and advantages of the invention follow from the subclaims, from the drawings, and from the corresponding figure description by means of the drawings.

It goes without saying that the above-mentioned features and the features, which will be described below, cannot only be used in the respective specified combination, but also in other combinations or alone, without leaving the scope of the present invention.

Preferred exemplary embodiments of the invention are illustrated in the drawings and will be described in more detail in the description below, whereby identical reference numerals refer to identical or similar or functionally identical components.

BRIEF DESCRIPTION OF THE DRAWINGS

In each case schematically

DETAILED DESCRIPTION

Figure 1:
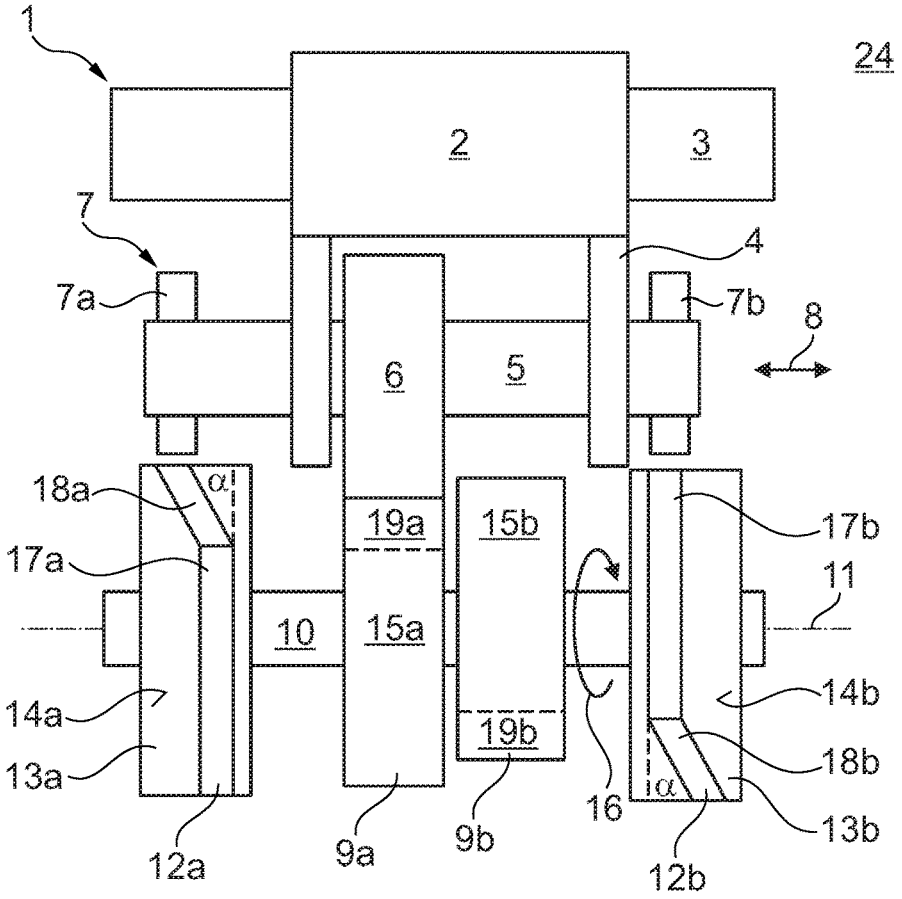
FIG. 1 shows a view of a rocker arm arrangement according to the invention.

FIG. 1 shows a view of a rocker arm arrangement 1 according to the invention for a valve drive of an internal combustion engine 24. The rocker arm arrangement 1 has a rocker arm 2, which is rotatably arranged on a rocker arm axis 3. A roller shaft 5 comprising a roll 6, which is rotatably and axially secured to the roller shaft 5, is arranged in a holder 4 of the rocker arm 2. The roller shaft 5 can be adjusted back and forth into a first position and into a second position by means of an adjusting arrangement 7 in the adjusting direction 8—which coincides with a longitudinal axis of the roller shaft 5—wherein, in the first position, the roll 6 of the roller shaft 5 is drivingly connected to a first cam 9*a*—as shown here—and, in the second position, to a second cam 9*b*. The cams 9*a* and 9*b* are secured to a cam shaft 10, which can be rotated about an axis of rotation 11, at a distance to one another and in a rotationally fixed manner. The adjusting arrangement 7 has a first engagement pin 7*a* and a second engagement pin 7*b*, which can be adjusted into a switching position and into a home position—as shown here—in the roller shaft 5 perpendicular to the adjusting device 8. In the switching position, the first engagement pin 7*a* thereby interacts with a first guide track 12*a*, and the second engagement pin 7*b* interacts with a second guide track 12*b*, and, in the home position, there is no contact with the respective guide track 12*a* or 12*b*. The roller shaft 5 can be adjusted from the first position into the second position by means of the first engagement pin 7*a*, and the roller shaft 5 can be adjusted from the second position into the first position by means of the second engagement pin 7*b*. The guide tracks 12*a* and 12*b* are thereby in each case embodied on a slide guide 13*a* and 13*b* as recess in an outer surface 14*a* and 14*b*, with which the engagement pins 7*a* and 7*b* engage in each case.

The guide tracks 12*a* and 12*b* are thereby arranged so as to overlap with a corresponding cam stroke region 15*a* and 15*b* of the cams 9*a* and 9*b* in the circumferential direction 16 of the cam shaft 10. In the switching position, the respective engagement pin 7*a* or 7*b* is located in the corresponding guide track 12*a* or 12*b* even when the cam stroke region 15*a* or 15 abuts on the roll 6. In the cam stroke region 15*a* and 15*b*, the radius of the respective cam 7*a* or 7*b* increases steadily, so that the respective engagement pin 7*a* and 7*b* is also removed steadily from the corresponding guide track 12*a* and 12*b* by means of the stroke movement of the roller shaft 5. When the respective cam stroke region 15*a* and 15*b* and the respective guide track 12*a* and 12*b* overlap, the respective engagement pin 7*a* and 7*b* can thus be guided further until the complete removal from the respective guide track 12*a* or 12*b*.

The guide tracks 12 and 12*b* thereby each have an idle speed track 17*a* and 17*b* and an axial guide track 18*a* and 18*b*, which can merge into one another via a bend or a curve. The respective engagement pins 7*a* and 7*b* can be adjusted axially to the axis of rotation 11 and the roller shaft 5 can be adjusted axially to the axis of rotation 11 and the roller shaft 5 along the adjusting direction 8 from the first position into the second position and back. For this purpose, the axial guide tracks 18*a* and 18*b* each have an angle $\alpha$ to the circumferential direction 16 of the cam shaft 10. The engagement pins 7*a* and 7*b* are held axially to the axis of rotation 11 by means of the idle speed tracks 17*a* and 17*b*. The idle speed tracks 17*a* and 17*b* thereby run in the circumferential direction 16 and the engagement pins 7*a* and 7*b* are not axially shifted by means of the idle speed tracks 17*a* and 17*b*. The axial guide tracks 18*a* and 18*b* thereby merge into the idle speed tracks 17*a* and 17*b*, so that the engagement pins 7*a* and 7*b* are guided without interruption in the guide tracks 12*a* and 12*b*. The idle speed tracks 17*a* and 17*b* overlap completely with the cam stroke regions 15*a* and 15*b* of the cams 9*a* and 9*b* in the circumferential direction 16 of the cam shaft 10, so that the engagement pins 7*a* and 7*b* are axially shifted by means of the axial guide tracks 18*a* and 18*b* and can be adjusted from the switching position into the home position by means of the idle speed tracks 17*a* and 17*b*. More time is thus available to adjust the engagement pins 7*a* and 7*b*, and the mechanical stress on the engagement pins 7*a* and 7*b* is reduced advantageously.

Figure 2:
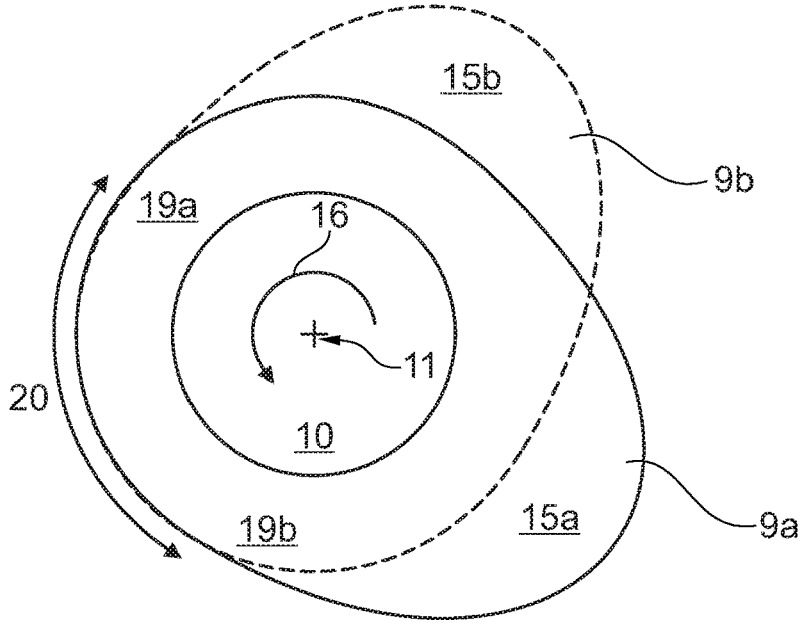
FIG. 2 shows a side view of a first and of a second cam on a cam shaft in a rocker arm arrangement according to the invention.

FIG. 2 shows a side view of the two cams 9*a* and 9*b* on the cam shaft 10. The cams 9*a* and 9*b* have the cam stroke regions 15*a* and 15*b* as well as idle speed regions 19*a* and 19*b*. In the respective idle speed region 19*a* or 19*b*, a radius of the respective cam 9*a* and 9*b* remains constant and the radius of the respective cam 9*a* and 9*b* changes steadily in the cam stroke region 15*a* and 15*b*. The two idle speed regions 19*a* and 19*b* thereby overlap to a total idle speed region 20 in the circumferential direction 16 of the cam shaft 10.

Figure 3:
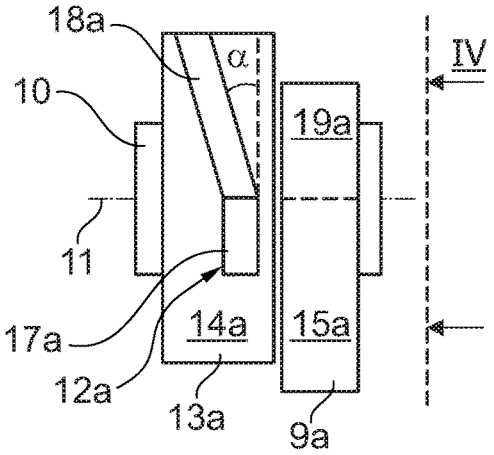
FIGS. 3 and 4 show views of a slide guide comprising a guide track and a corresponding cam on a cam shaft.
Figure 4:
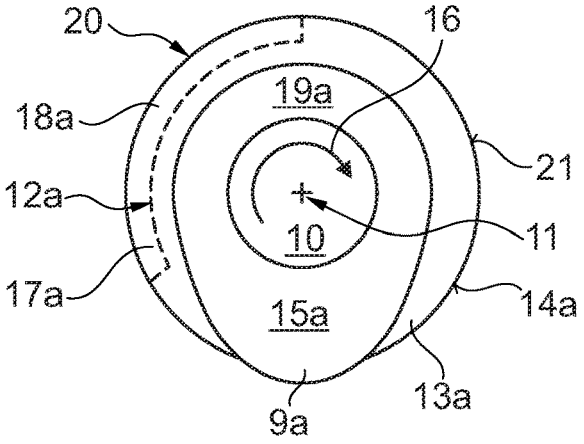

FIG. 3 and FIG. 4 show views of the slide guide 13*a* comprising the guide track 12*a* and the corresponding cam 9*a*. It goes without saying that the slide guide 13*b* comprising the corresponding guide track 12*b* can be embodied in the same way. In this exemplary embodiment, the guide track 12*a* has the idle speed track 17*a* and the axial guide track 18*a*. The axial guide track 18*a* and the idle speed region 19*a* of the cam 9*a* are thereby arranged so as to overlap completely. In addition, the overlapped idle speed region 19*a* of the cam 9*a* corresponds to the total idle speed region 20 of the two cams 9*a* and 9*b*. The roll 6 of the roller shaft 5 can be adjusted from the first cam 9*a* to the second cam 9*b* by means of the guide track 12*a* in this way, without one of the cam stroke regions 15*a* or 15*b* of the two cams 9*a* and 9*b* preventing the movement of the roll 6 and of the roller shaft 5.

In this exemplary embodiment, the slide guide 13*a* for adjusting the engagement pin 7*a* into the home position has a resetting surface 21 on the outer surface 14*a*. The resetting surface 21 is arranged so as to overlap with the idle speed region 19*a* of the cam 9*a* in the circumferential direction 16. The idle speed track 17*a* thereby ends in the cam stroke region 15*a*, wherein the engagement pin 7*a*, which has already been axially adjusted, is only guided further in the idle speed track 17*a*. When the idle speed track 17*a* overlaps with the cam stroke region 15*a*, the radius of the cam 9*a* as well as the distance of the engagement pin 7*a* to the cam shaft 10 increases. The engagement pin 7*a* is accordingly removed from the idle speed track 17*a* by means of the stroke movement of the roller shaft 5. In response to a reverse stroke movement of the roller shaft 5, the engagement pin 7*a* strikes the resetting surface 21 of the slide guide 13*a* into the home position and is adjusted. A connection between the motion sequence of the cam 9*a* and of the slide guide 13*a* is also illustrated in FIG. 9 under A.

Figure 5:
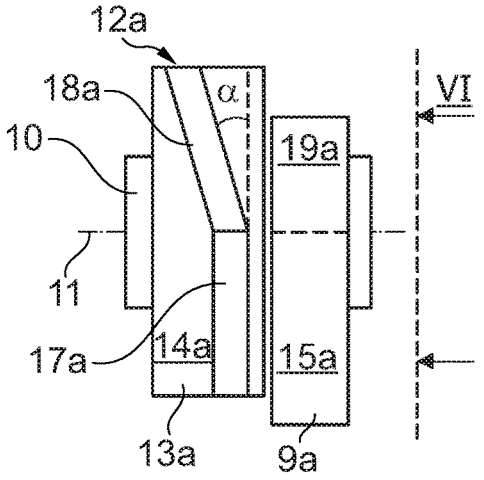
FIGS. 5 and 6 show views of a slide guide comprising an alternatively embodied guide track and of a corresponding cam on a cam shaft.
Figure 6:
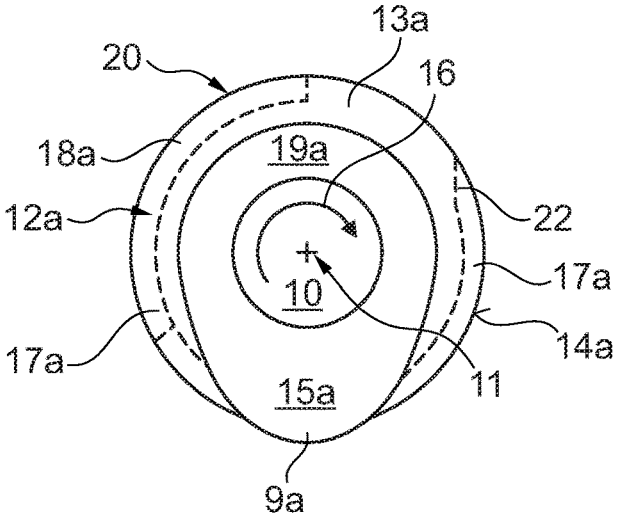

FIG. 5 and FIG. 6 show views of the slide guide 13*a* comprising the alternatively embodied guide track 12*a* and of the cam 9*a*. It also goes without saying that the slide guide 13*b* comprising the corresponding guide track 12*b* can be embodied in the same way. The axial guide track 18*a* and the total idle speed region 20 of the two cams 9*a* and 9*b* are arranged so as to overlap completely in the circumferential direction 16 of the cam shaft 10. In this exemplary embodiment, the idle speed track 17*a* is arranged so as to overlap with the cam stroke region 15*a* and with the idle speed region 19*a* of the cam 9*a*. The engagement pin 7*a* is removed from the idle speed track 17*a* by means of the stroke movement of the roller shaft 5 and then dips into the idle speed track 17*a* again in response to the reverse stroke movement of the roller shaft 5. In the idle speed region 19*a*, the idle speed track 17*a* merges into a ramp region 22, by means of which the engagement pin 7*a* is adjusted into the home position. A connection between the motion sequence of the cam 9*a* and of the slide guide 13*a* is also illustrated in FIG. 9 under B.

Figure 7:
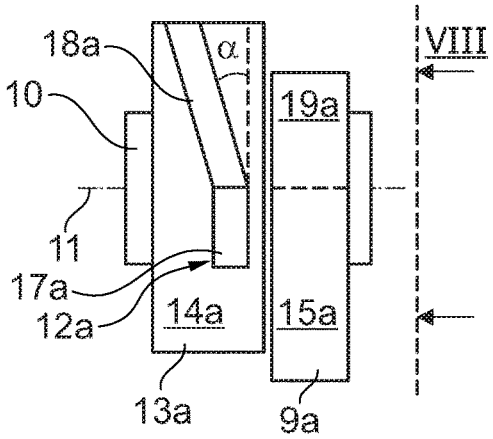
FIGS. 7 and 8 show views of a slide guide comprising a further alternatively embodied guide track and of a corresponding cam on a cam shaft.
Figure 8:
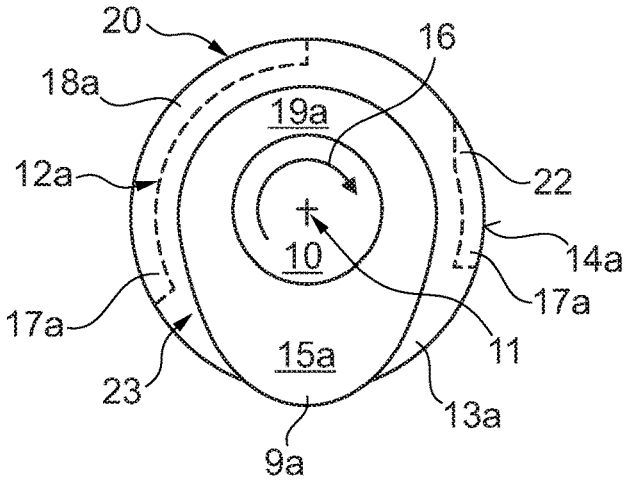

FIG. 7 and FIG. 8 show views of the slide guide 13*a* comprising the alternatively embodied guide track 12*a* and of the cam 9*a*. In this exemplary embodiment, the idle speed track 17*a* is interrupted by an interruption region 23, because the engagement pin 7*a* does not have any contact with the slide guide 13*a* in the interruption region 23 as a result of the stroke movement of the roller shaft 5. It goes without saying that the slide guide 13*b* comprising the corresponding guide track 12*b* can be embodied in the same way. A connection between the motion sequence of the cam 9*a* and of the slide guide 13*a* is illustrated in FIG. 9 under C.

Figure 9:
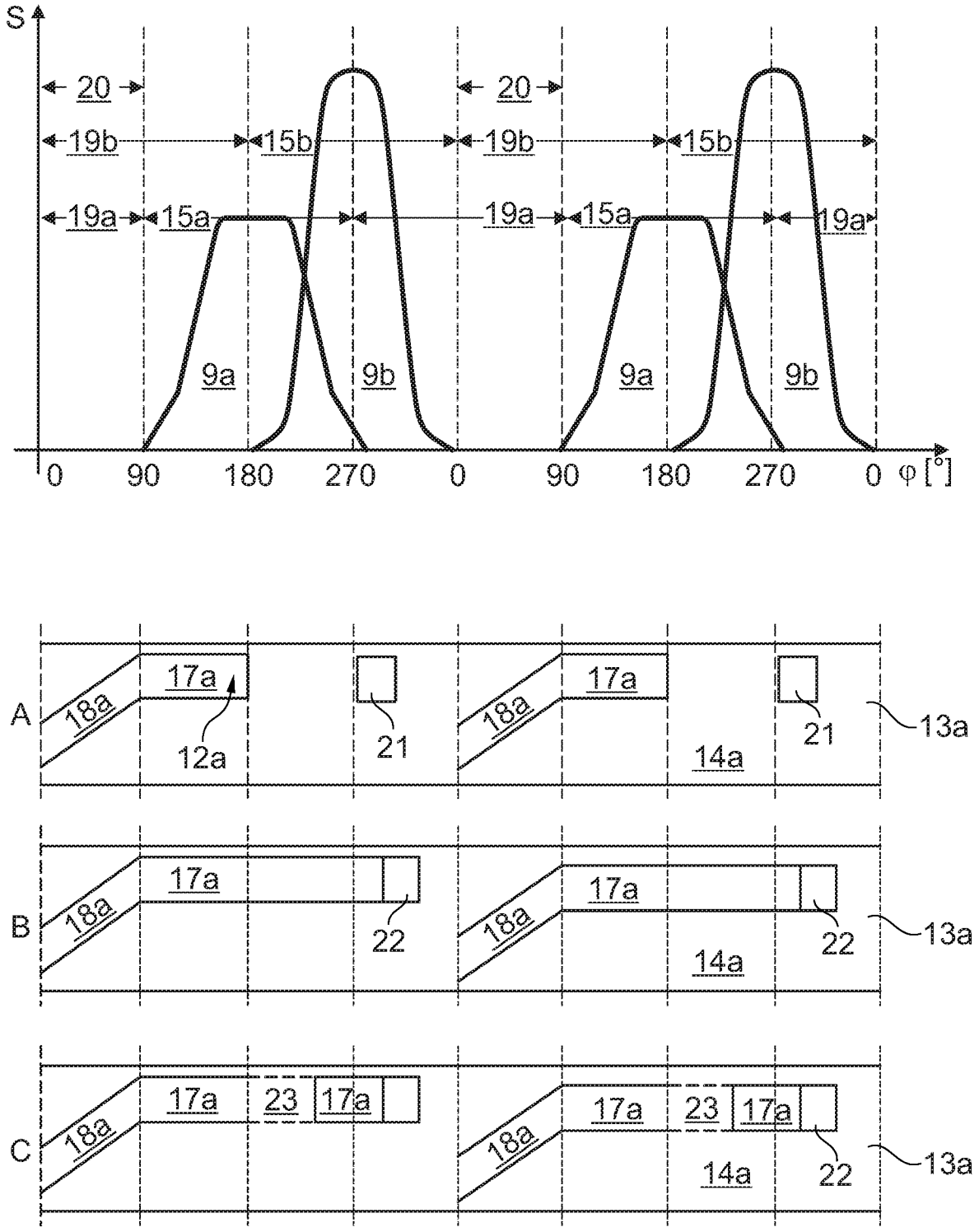
FIG. 9 shows a motion sequence of the slide guides shown in FIG. 3 to FIG. 8 in connection with a motion sequence of the corresponding cams.

FIG. 9 shows motion sequences of the slide guides 13*a* shown in FIG. 3 to FIG. 8 comprising the alternatively embodied guide tracks 12*a* in connection with the corresponding cam 9*a*. The motion sequence of the slide guide 13*a* shown in FIG. 3 and FIG. 4 is shown under A, the motion sequence of the slide guide 13 shown in FIG. 5 and FIG. 6 is shown under B, and the motion sequence of the slide guide 13*a* shown in FIG. 7 and FIG. 8 is shown under C. The relative hub S of the roll 6 is shown as a function of an angle of rotation φ of the cam shaft 10 about the axis of rotation 11 is shown in the motion sequence of the cams 9*a* and 9*b*.

The invention claimed is:

1. A rocker arm arrangement for a valve drive of an internal combustion engine comprising:

a roller shaft including at least one roll rotatably mounted and axially secured to the roller shaft;

an adjusting arrangement configured to adjust the roller shaft between a first position and a second position along an adjusting direction;

the at least one roll of the roller shaft drivingly connected to a first cam when in the first position and drivingly connected to a second cam when in the second position;

the first cam and the second cam respectively having a cam stroke region and an idle speed region and secured in a rotationally fixed manner to a cam shaft rotatable about an axis of rotation;

the adjusting arrangement including a first engagement pin and a second engagement pin respectively arranged on the roller shaft, the first engagement pin and the second engagement pin respectively adjustable in a direction perpendicular to the adjusting direction into a switching position and into a home position;

the first engagement pin and the second engagement pin interacting with a first guide track and a second guide track, respectively, when in the switching position and not contacting the first guide track and the second guide track, respectively, when in the home position; and the first guide track arranged on the cam shaft in a circumferential direction of the cam shaft to at least partially overlap one of the cam stroke region of the first cam and the cam stroke region of the second cam, and the second guide track arranged on the cam shaft in the circumferential direction of the cam shaft to at least partially overlap one of the cam stroke region of the second cam and the cam stroke region of the first cam.

2. The rocker arm arrangement according to claim 1, wherein:

the first guide track is defined by a first radial recess disposed in an outer surface of a first slide guide and extending at least partially around the axis of rotation; and the second guide track is defined by a second radial recess disposed in an outer surface of a second slide guide and extending at least partially around the axis of rotation.

3. The rocker arm arrangement according to claim 2, wherein the outer surface of the first slide guide and the outer surface of the second slide guide each include a resetting surface arranged to at least partially overlap one of the idle speed region and the cam stroke region of one of the first cam and the second cam in the circumferential direction of the cam shaft.

4. The rocker arm arrangement according to claim 1, wherein the first guide track and the second guide track respectively include at least one idle speed track and at least one axial guide track, an associated engagement pin of the first engagement pin and the second engagement pin adjustable axially relative to the axis of rotation via the at least one axial guide track and axially fixed relative to the axis of rotation via the at least one idle speed track.

5. The rocker arm arrangement according to claim 4, wherein at least one of:

the at least one axial guide track of the first guide track and the at least one axial guide track of the second guide track merge into the at least one idle speed track of the first guide track and the at least one idle speed track of the second guide track, respectively; and the at least one idle speed track of the first guide track and the at least one idle speed track of the second guide track merge into the at least one axial guide track of the first guide track and the at least one axial guide track of the second guide track, respectively.

6. The rocker arm arrangement according to claim 4, wherein at least one of:

the at least one idle speed track of the first guide track and the at least one idle speed track of the second guide track are each arranged to at least partially overlap the cam stroke region of one of the first cam and the second cam in the circumferential direction of the cam shaft; and the at least one idle speed track of the first guide track and the at least one idle speed track of the second guide track are each arranged to completely overlap the cam stroke region of one of the first cam and the second cam in the circumferential direction of the cam shaft.

7. The rocker arm arrangement according to claim 4, wherein at least one of:

the at least one axial guide track of the first guide track and the at least one axial guide track of the second guide track are each arranged to at least partially overlap the idle speed region of one of the first cam and the second cam in the circumferential direction of the cam shaft; and the at least one axial guide track of the first guide track and the at least one axial guide track of the second guide track are each arranged to completely overlap the idle speed region of one of the first cam and the second cam in the circumferential direction of the cam shaft.

8. The rocker arm arrangement according to claim 4, wherein the at least one axial guide track of the first guide track, the at least one axial guide track of the second guide track, and a total idle speed region are arranged completely overlapping in the circumferential direction of the cam shaft, and wherein, in the total idle speed region, the idle speed region of the first cam and the idle speed region of the second cam are arranged overlapping one another in the circumferential direction of the cam shaft.

9. The rocker arm arrangement according to claim 4, wherein:

the first guide track is defined by a first radial recess in an outer surface of a first slide guide, the first radial recess extending at least partially around the axis of rotation;

the second guide track is defined by a second radial recess in an outer surface of a second slide guide, the second radial recess extending at least partially around the axis of rotation;

the at least one idle speed track of the first guide track has a first ramp region extending from the first radial recess to the outer surface of the first slide guide via which the associated engagement pin is adjustable perpendicularly to the adjusting direction of the roller shaft; and the at least one idle speed track of the second guide track has a second ramp region extending from the second radial recess to the outer surface of the second slide guide via which the associated engagement pin is adjustable perpendicular to the adjusting direction in the roller shaft.

10. The rocker arm arrangement according to claim 9, wherein the first ramp region and the second ramp region are each arranged to at least partially overlap the cam stroke region of one of the first cam and the second cam in the circumferential direction of the cam shaft.

11. The rocker arm arrangement according to claim 9, wherein the first ramp region and the second ramp region are each arranged to at least partially overlap the idle speed region of one of the first cam and the second cam in the circumferential direction of the cam shaft.

12. The rocker arm arrangement according to claim 11, wherein the at least one idle speed track of the first guide track and the at least one idle speed track of the second guide track are each interrupted by an interruption region arranged to at least partially overlap the cam stroke region of one of the first cam and the second cam in the circumferential direction of the cam shaft.

13. The rocker arm arrangement according to claim 4, wherein at least one of the first engagement pin and the second engagement pin is adjustable axially relative to the axis of rotation downstream from a respective axial guide track of the first guide track and the second guide track, and is in the switching position in the cam stroke region of one of the first cam and the second cam.

14. The rocker arm arrangement according to claim 1, further comprising a shared slide guide, wherein:

the first guide track is defined by a first radial recess disposed in an outer surface of the shared slide guide and extending at least partially around the axis of rotation; and the second guide track is defined by a second radial recess disposed in the outer surface of the shared slide guide and extending at least partially around the axis of rotation.

15. A rocker arm arrangement for a valve drive of an internal combustion engine comprising:

a roller shaft;

at least one roll rotatably mounted and axially secured to the roller shaft;

an adjusting arrangement configured to adjust the roller shaft in an adjusting direction between a first position and a second position, the adjusting arrangement including a first engagement pin and a second engagement pin respectively arranged on the roller shaft, the first engagement pin and the second engagement pin respectively adjustable in a direction perpendicular to the adjusting direction into a switching position and into a home position;

a cam shaft rotatable about an axis of rotation, the cam shaft including a first cam, a second cam, a first slide guide, and a second slide guide, the first cam and the second cam coupled to the cam shaft in a rotationally fixed manner and respectively having a cam stroke region and an idle speed region;

a first guide track extending in a circumferential direction of the cam shaft, the first guide track defined by a first radial recess disposed in an outer surface of the first slide guide, the first radial recess extending at least partially around the axis of rotation, and the first guide track arranged to at least partially overlap one of the cam stroke region of the first cam and the cam stroke region of the second cam; and a second guide track extending in a circumferential direction of the cam shaft, the second guide track defined by a second radial recess disposed in an outer surface of the second slide guide, the second radial recess extending at least partially around the axis of rotation, and the second guide track arranged to at least partially overlap one of the cam stroke region of the second cam and the cam stroke region of the first cam;

wherein the at least one roll is drivingly connected to the first cam when in the first position and drivingly connected to the second cam when in the second position; and wherein the first engagement pin and the second engagement pin interact with the first guide track and the second guide track, respectively, when in the switching position, and do not contact the first guide track and the second guide track, respectively, when in the home position.

16. The rocker arm arrangement according to claim 15, wherein the first guide track and the second guide track respectively include at least one idle speed track and at least one axial guide track, an associated engagement pin of the first engagement pin and the second engagement pin adjustable axially relative to the axis of rotation via the at least one axial guide track and axially fixed relative to the axis of rotation via the at least one idle speed track.

17. The rocker arm arrangement according to claim 16, wherein the at least one axial guide track of the first guide track, the at least one axial guide track of the second guide track, and a total idle speed region are arranged completely overlapping in the circumferential direction of the cam shaft, and wherein, in the total idle speed region, the idle speed region of the first cam and the idle speed region of the second cam are arranged overlapping one another in the circumferential direction of the cam shaft.

18. The rocker arm arrangement according to claim 15, wherein the outer surface of the first slide guide and the outer surface of the second slide guide each include a resetting surface arranged to at least partially overlap one of the idle speed region and the cam stroke region of one of the first cam and the second cam in the circumferential direction of the cam shaft.

19. A rocker arm arrangement for a valve drive of an internal combustion engine comprising:

a roller shaft;

at least one roll rotatably mounted and axially secured to the roller shaft;

an adjusting arrangement configured to adjust the roller shaft in an adjusting direction between a first position and a second position, the adjusting arrangement including a first engagement pin and a second engagement pin respectively arranged on the roller shaft the first engagement pin and the second engagement pin respectively adjustable in a direction perpendicular to the adjusting direction into a switching position and into a home position;

a cam shaft rotatable about an axis of rotation, the cam shaft including a first cam and a second cam coupled to the cam shaft in a rotationally fixed manner and respectively having a cam stroke region and an idle speed region; and a first guide track and a second guide track arranged on the cam shaft and extending in a circumferential direction of the cam shaft, the first guide track arranged to at least partially overlap one of the cam stroke region of the first cam and the cam stroke region of the second cam, the second guide track arranged to at least partially overlap one of the cam stroke region of the second cam and the cam stroke region of the first cam;

the first guide track and the second guide track respectively including at least one idle speed track and at least one axial guide track, the at least one axial guide track configured to axially adjust an associated engagement pin of the first engagement pin and the second engagement pin relative to the axis of rotation, the at least one idle speed track configured to axially fix the associated engagement pin relative to the axis of rotation;

wherein the at least one roll is drivingly connected to the first cam when in the first position and drivingly connected to the second cam when in the second position; and wherein the first engagement pin and the second engagement pin interact with the first guide track and the second guide track, respectively, when in the switching position, and do not contact the first guide track and the second guide track, respectively, when in the home position.

20. The rocker arm arrangement according to claim 19, wherein:

the first guide track is defined by a first radial recess in an outer surface of a first slide guide, and the second guide track is defined by a second radial recess in an outer surface of a second slide guide, the first radial recess and the second radial recess extending at least partially around the axis of rotation;

the outer surface of the first slide guide and the outer surface of the second slide guide each include a resetting surface arranged to at least partially overlap one of the idle speed region and the cam stroke region of one of the first cam and the second cam in the circumferential direction of the cam shaft.

* * * * *